US006605787B1

(12) United States Patent
Chu

(10) Patent No.: US 6,605,787 B1
(45) Date of Patent: Aug. 12, 2003

(54) ELECTRICAL SWITCH

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 0 days.

(21) Appl. No.: 10/237,804

(22) Filed: Sep. 10, 2002

(51) Int. Cl.[7] ..... H01H 21/18; H01H 1/12; H01H 21/62

(52) U.S. Cl. ..... 200/11 G; 200/6 B; 200/6 R; 200/11 R; 200/275

(58) Field of Search ..... 200/6 R, 6 B, 200/6 BA, 6 BB, 6 C, 11 R, 11 A–11 EA, 11 G, 11 J–11 TW, 275, 283, 284

(56) References Cited

U.S. PATENT DOCUMENTS 1,999,019 A * 4/1935 Hall et al. ..... 200/6 C
2,813,158 A * 11/1957 Hutt ..... 200/6 BB
3,748,419 A * 7/1973 Torrey et al. ..... 200/6 R X
3,780,245 A * 12/1973 Beddow ..... 200/564
5,343,004 A * 8/1994 Chen ..... 200/11 R
5,728,982 A * 3/1998 Rao et al. ..... 200/6 R

* cited by examiner

*Primary Examiner*—J. R. Scott
(74) *Attorney, Agent, or Firm*—Leydig, Voit & Mayer, Ltd.

(57) ABSTRACT

An electrical switch comprising a casing and a rotor supported within the casing for rotation about an axis. The rotor has a first surface extending around the axis and a second surface extending transversely of the axis. A moving contact is mounted on the rotor for rotation therewith, which has first and second inter-connected parts adjacent the first and second rotor surfaces respectively. A plurality of fixed contacts is located laterally of the rotor for short-circuiting by the moving contact whereby the switch is closed. At least one of the fixed contacts has first and second inter-connected parts bearing resiliently against the first and second rotor surfaces respectively for contact with the corresponding fist and second moving contact parts according to the angular position of the rotor.

12 Claims, 6 Drawing Sheets

ELECTRICAL SWITCH

The present invention relates to an electrical switch and, more particularly but not exclusively, to a rotary switch.

BACKGROUND OF THE INVENTION

An electrical switch of the type concerned typically comprises a casing, an internal rotor, a moving contact mounted on the rotor for rotation, and a plurality of fixed contacts in the casing for short-circuiting by the moving contact. Whilst the moving contact can be designed to provide different switching combinations between the fixed contacts, the variation of such combinations has been found to be rather limited, primarily by reason of the invariable design of the fixed contacts.

The invention seeks to mitigate or at least alleviate such a problem by providing an improved electrical switch.

SUMMARY OF THE INVENTION

According to the invention, there is provided an electrical switch comprising a casing and a rotor supported within the casing for rotation about an axis. The rotor has a first surface extending around the axis and a second surface extending transversely of the axis. A moving contact is mounted on the rotor for rotation therewith, which has first and second inter-connected parts adjacent the first and second rotor surfaces respectively. A plurality of fixed contacts is located laterally of the rotor for short-circuiting by the moving contact wherein the switch is closed. At least one of the fixed contacts has first and second inter-connected parts bearing resiliently against the first and second rotor surfaces respectively for contact with the corresponding first and second moving contact parts according to the angular position of the rotor.

Preferably, the first and second surfaces of the rotor includes recesses locating the first and second parts of the moving contact respectively, therein accommodating their thickness.

It is preferred that the rotor has a generally flat cylindrical body including a peripheral surface as its first surface and one of its end surfaces as the second surface.

In a preferred embodiment, the second moving contact part extends partially round the axis, and the first moving contact part extends substantially at right angles relative to the second part.

More preferably, the moving contact has a generally flat body that is folded to form its first and second parts.

It is preferred that the second part of said one fixed contact extends substantially at right angles relative to the first part.

It is further preferred that said one fixed contact has a body that comprises a base bent to form the first part and a side portion folded about the base to form the second part.

It is yet further preferred that the base of the fixed contact body is generally Z-shaped, having one end acting as the first part, the opposite end acting as a terminal for connection with an electric cable, and a middle section from which the side portion extends.

It is yet further preferred that the fixed contact body is generally T-shaped prior to the formation of its parts through bending and folding.

In a specific construction, the casing has a substantially square shape, including a pair of diametrically opposite corners, within each of which a respective said one fixed contact is located.

More specifically, in an embodiment the second moving contact part extends over 180° round the axis.

As an example, the electrical switch is a rotary switch with the rotor being rotatable over 360° in opposite directions.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
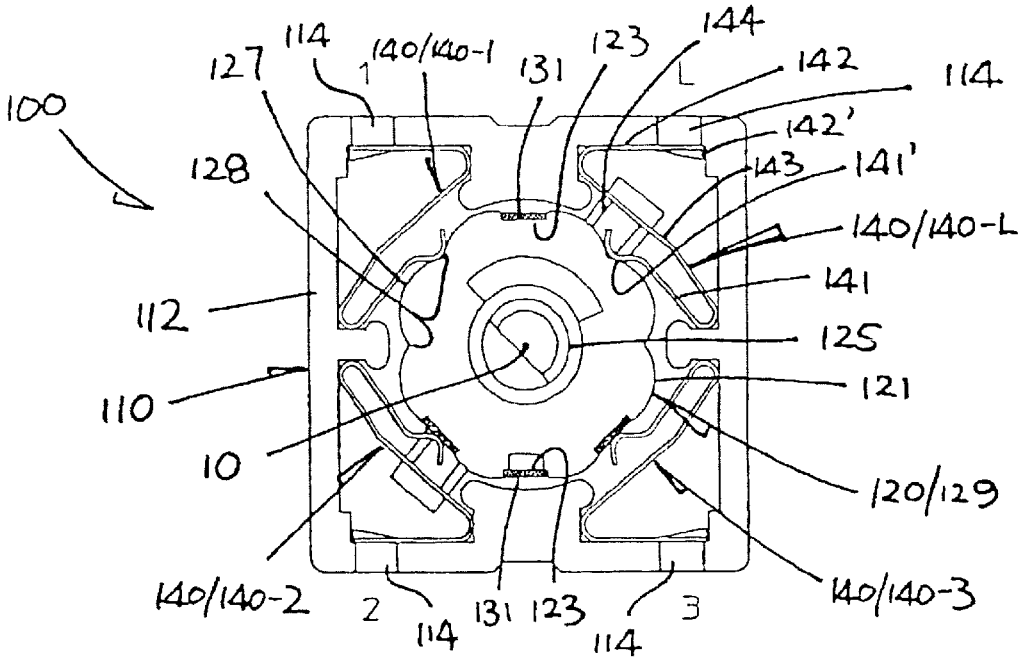
FIGS. 1 and 2 are top and bottom plan views showing the interior of an embodiment of an electrical switch in accordance with the invention, said switch being in an OFF condition.

Referring to the drawings, there is shown an electrical switch 100 embodying the invention, which switch 100 has a generally flat square casing 110 and a rotor 120 supported centrally within the casing 110 for rotation over 360° in opposite directions about an axis 10 perpendicular to the casing 110. The switch 100 is therefore a rotary switch. The casing 110 is formed by a generally flat square base 112 and a square lid 113 closing an open top side of the casing 110. The casing 110 includes four terminal holes 114 at its corners for the insertion of external electric cables from a power source and load.

The rotor 120 has a generally flat cylindrical or disc-like body 129 which includes a peripheral surface 121 extending around the axis 10 and a generally flat bottom end surface 122 extending transversely of the axis 10. The peripheral surface 121 has a wavy profile including eight equiangularly spaced (pointed) valleys 128, with the adjacent valleys 128 of each pair separated by a respective convex crest 127. The $1^{st}$ and $4^{th}$ to $6^{th}$ valleys 128 are flattened into respective flat shallow recesses 123. The bottom end surface 122 is formed with an arcuate flat shallow recess 124 that extends over 270° (at least 180°) partially round the axis 10.

The rotor 120 includes an integral central shaft 125 that projects vertically upwardly out of the casing 110 through the lid along the axis 10, for fitting with a turning knob (not shown) to facilitate manual rotation of the rotor 120.

The switch 100 includes a moving contact 130 mounted fast on the rotor 120 for rotation therewith. The moving contact 130 has a generally flat body 139 that is folded to form an arcuate flat base 132 and four small side tabs 132 extending at right angles integrally from the outer edge of the base 132.

The recesses 123 and 124 have a combined shape generally complimentary (at lest in part) to that of the tabs 131 and base 132, and locate the moving contact 130 fixedly within the surfaces 121 and 122 of the rotor 120. In particular, the recesses 123 and 124 accommodate substantially the entire thickness of the tabs 131 and base 132. This results in the outer surfaces of the moving contact 130 and the rotor 120 lying flush with each other, thereby giving rise to a practically smooth transition between them in either direction of rotation of the rotor 120.

The switch 100 further includes four fixed contacts 140 which are equiangularly located within respective corners of the casing 110, laterally around the rotor 120, for short-circuiting by the moving contact 130, wherein the switch 100 is closed. Each fixed contact 140 has a body 149 comprising a generally Z-shaped base 148 that is bent to provide a pair of opposite front and rear sections 141 and 142 and a middle section 143 extending in between.

The front section 141 of each fixed contact 140 is shaped generally like a spoon at its free end 141' bearing resiliently against the peripheral surface 121 of the rotor 120 for, in particular, contact with the side tabs 131 of the moving contact 130. This represents a first contact action between the movable and the fixed contacts along the rotor peripheral surface 121.

The four spoon-shaped ends 141' are also engageable with at least one of the pointed valleys 128 of the peripheral surface 121, i.e. those valleys 128 that are not occupied by the tabs 131, to define a total number of eight stable angular positions for the rotor 120.

The rear section 142 is made to have a generally V-shaped cross-section at its free end 142' that extends behind a corresponding hole 114 of the casing 110, acting as a terminal for self-gripping connection with an electric cable inserted into the hole 114. Thus, the switch 100 has a total number of four terminals for connection, namely terminal L (for the live circuit of an AC power source) and terminals 1, 2 and 3 (for a load). For simplicity, the fixed contacts associated with the terminals L, 1, 2 and 3 are differentiated by the reference numerals 140-L, 140-1, 140-2 and 140-3 respectively.

Each of the fixed contacts 140-L and 140-2 at one of the two pairs of diametrically opposite corners of the casing 110 includes an additional contact part 144, compared with the other two fixed contacts 140-1 and 140-3. The additional contact part 144 is in the form of an integral leg 144 that is folded to extend generally at right angles from the bottom edge of the middle section 143 at an intermediate position thereof. As a whole, the fixed contact body 149 concerned is generally T-shaped, or having three legs, prior to the formation of its various parts through bending, folding and shaping as described above.

Each contact leg 144 has a free end 144' that is dented from below to form a protruding contact on its upper side bearing resiliently against the bottom end surface 122 of the rotor 120 for contact with the arcuate base 132 of the moving contact 130. This represents another, second contact action between the movable and fixed contacts along the rotor bottom end surface 122.

The switch 100 may be used, for example, in an electric heater (or fan) to control its heating element (or motor). In the simplest form, terminal L acts as a common terminal to which the mains power live circuit is connected, whereas separate heating elements are connected to the other terminals 1, 2 and 3 for selective energization.

Figure 2:
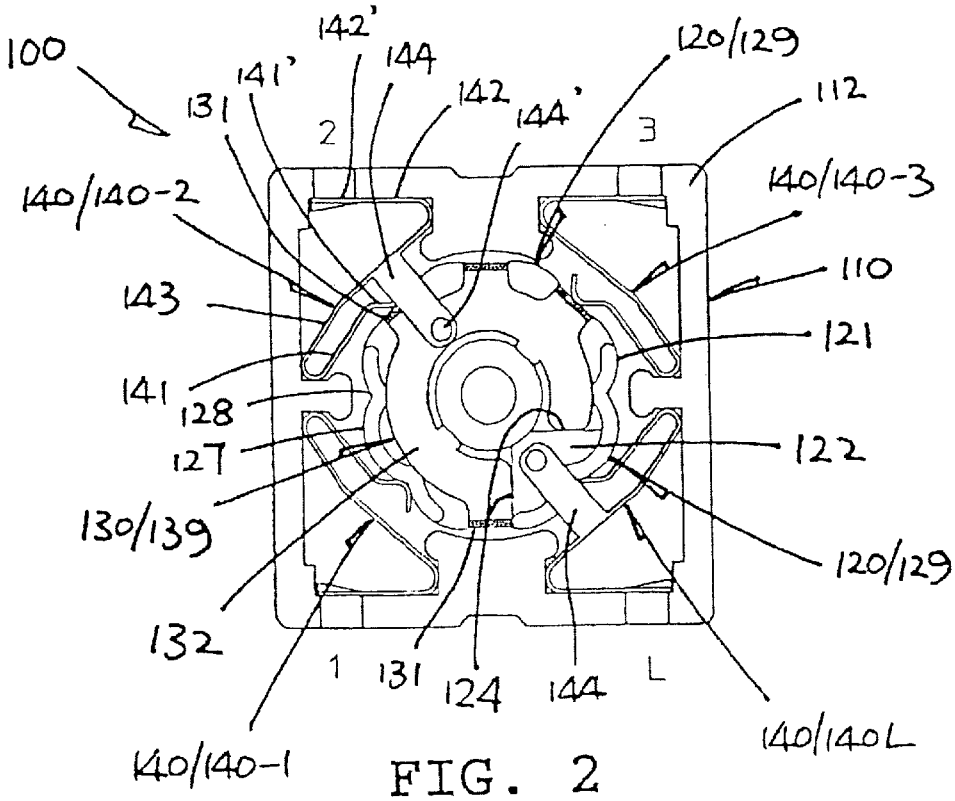
Figure 1A:
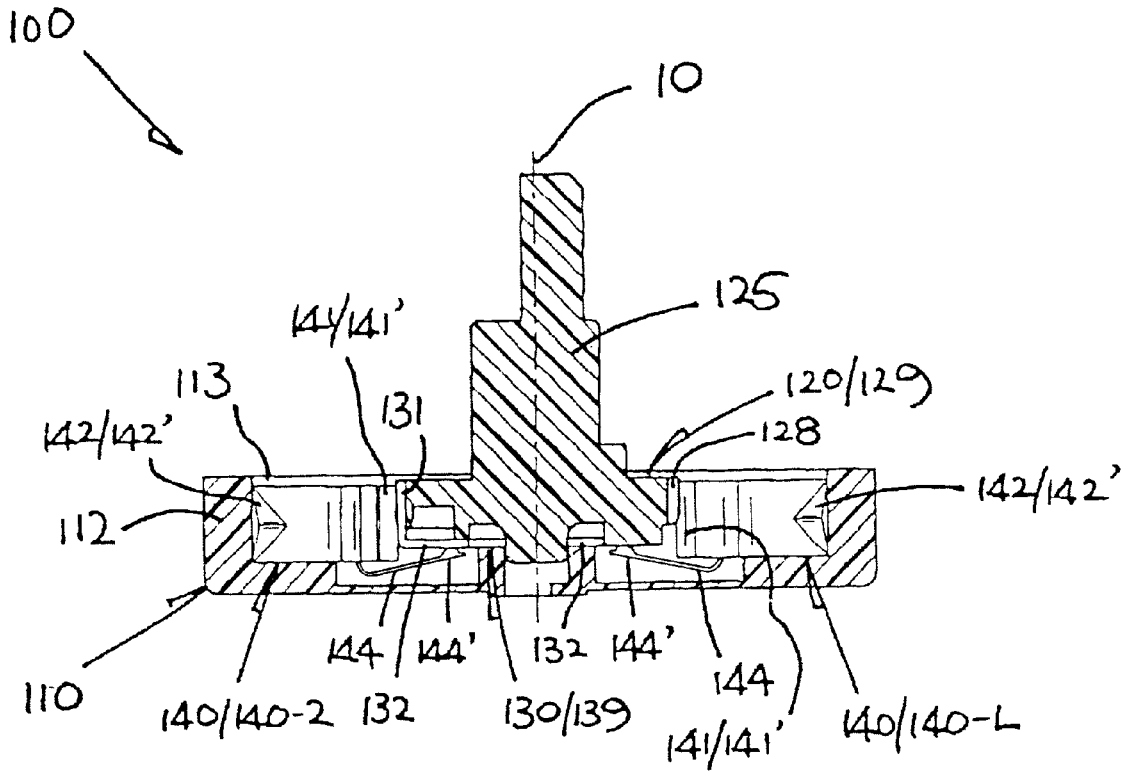
FIG. 1A is a cross-sectional side view of the switch of FIG. 1, taken diagonally thereof.

FIGS. 1 and 2 show an OFF condition of the switch 100 in use, in which the moving contact 130 is turned by the rotor 120 into a stable angular position separated from the live fixed contact 140-L. While in isolation, the moving contact 130 is unable to deliver any power from the mains power source to all the heating elements.

Figure 3:
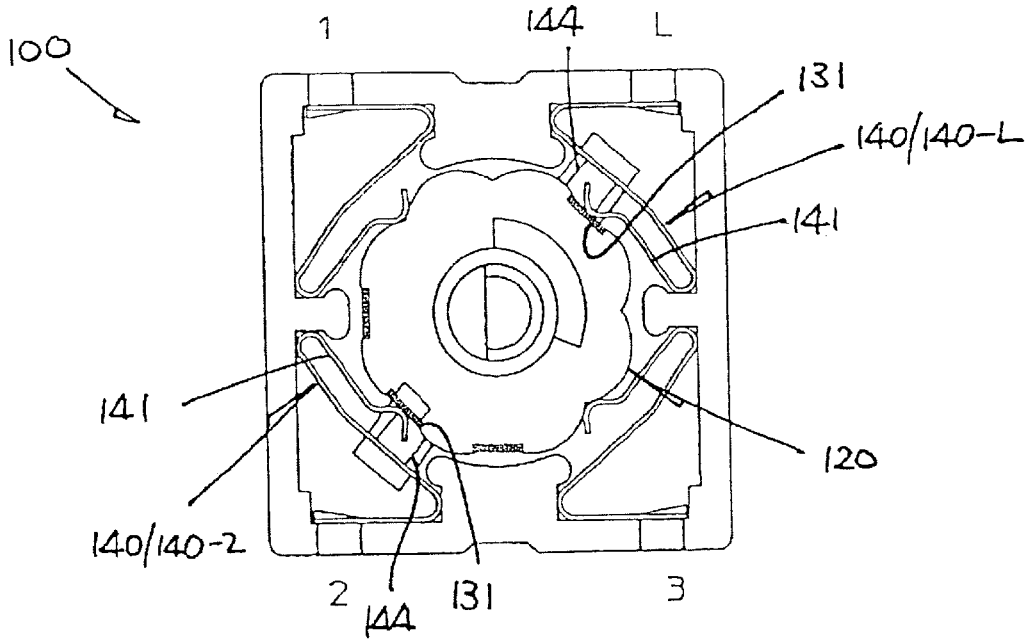
FIGS. 3 and 4 are top and bottom plan views showing the interior of the switch of FIGS. 1 and 2, said switch being in an ON condition.
Figure 4:
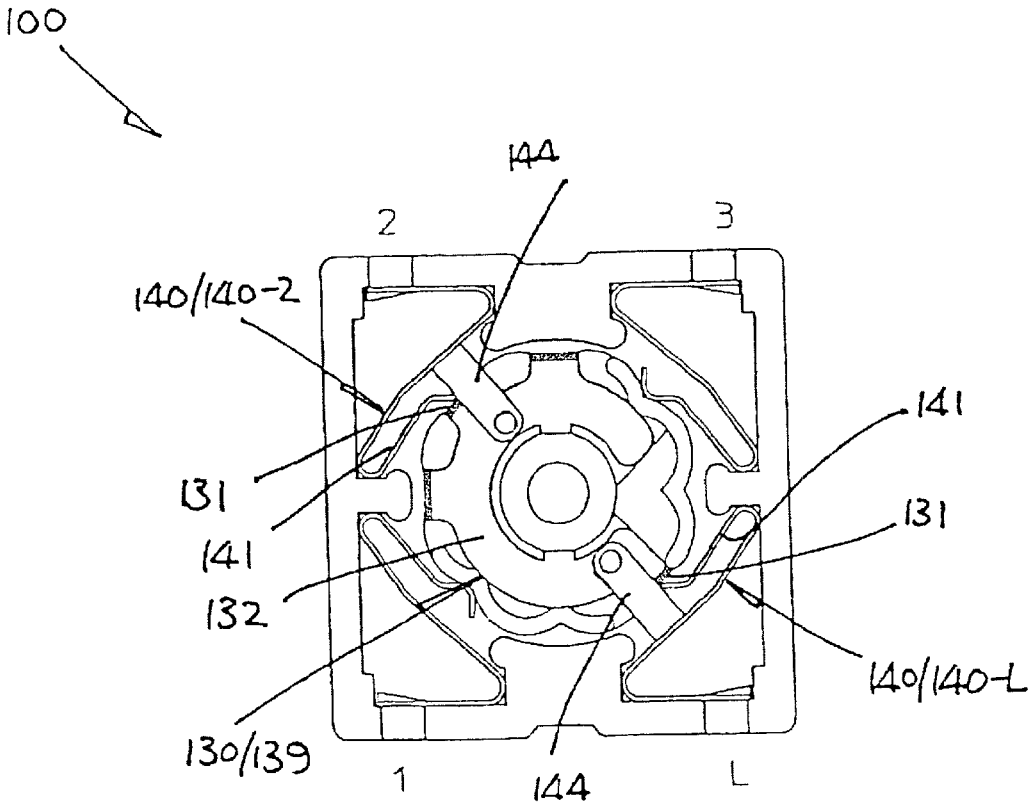

FIGS. 3 and 4 show a first ON condition (L-2) of the switch 100, in which the moving contact 130 has been turned through 45° from the previous position into contact with the live fixed contact 140-L. The moving contact 130 is in contact via its nearest tab 131 with the front section 141 of the live fixed contact 140-L (the aforesaid first contact action) and also via its base 132 with the associated contact leg 144 (the aforesaid second contact action). Amongst the other fixed contacts 140, only the contact 140-2 is contacting the moving contact 130 and likewise by means of both its front section 141 and its contact leg 144 (hence double contact actions). Thus, the heating element at terminal 2 is switched to terminal L and in turn connected to the power source.

Figure 5:
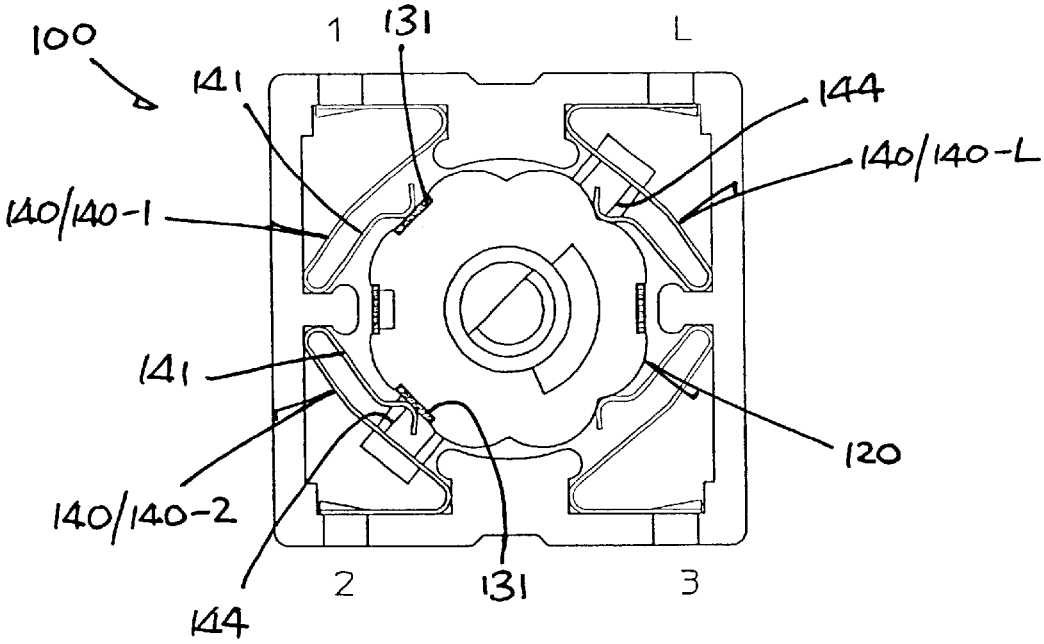
FIGS. 5 and 6 are top and bottom plan views showing the interior of the switch of FIGS. 1 and 2, said switch being in another ON condition.
Figure 6:
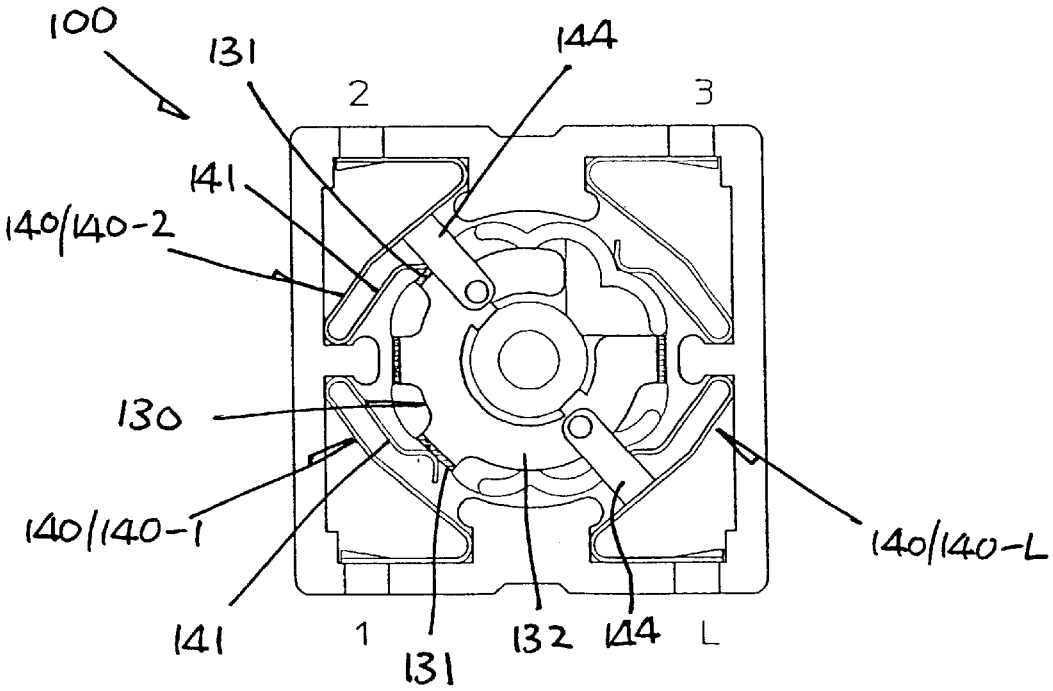
Figure 7:
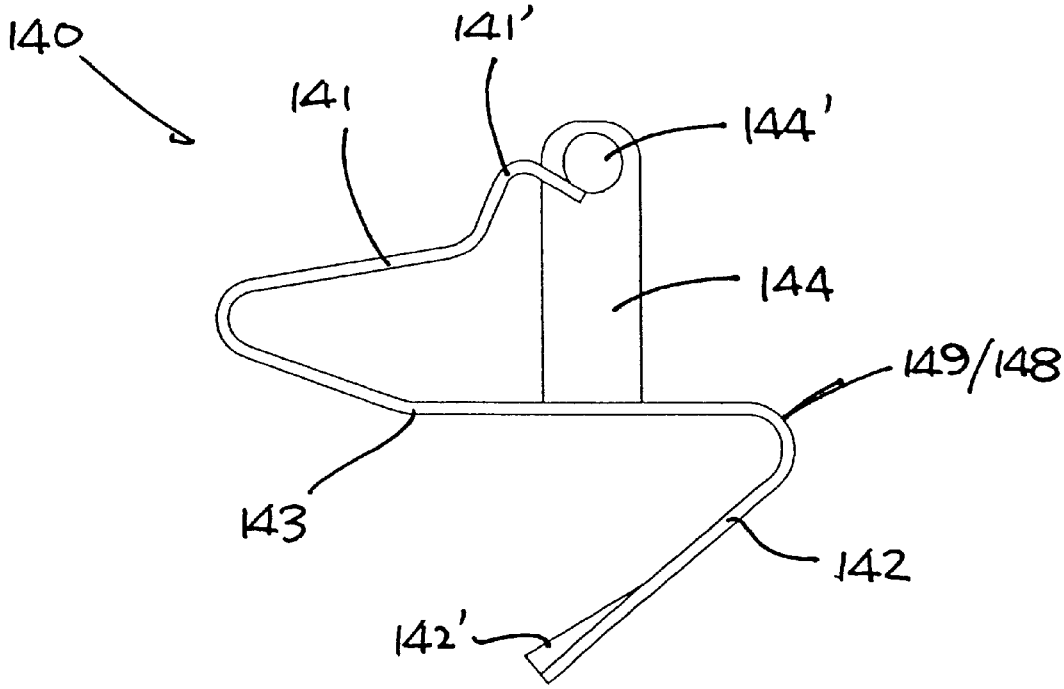
FIGS. 7 and 8 are top and side views of a fixed contact of the switch of FIGS. 1 and 2.
Figure 8:
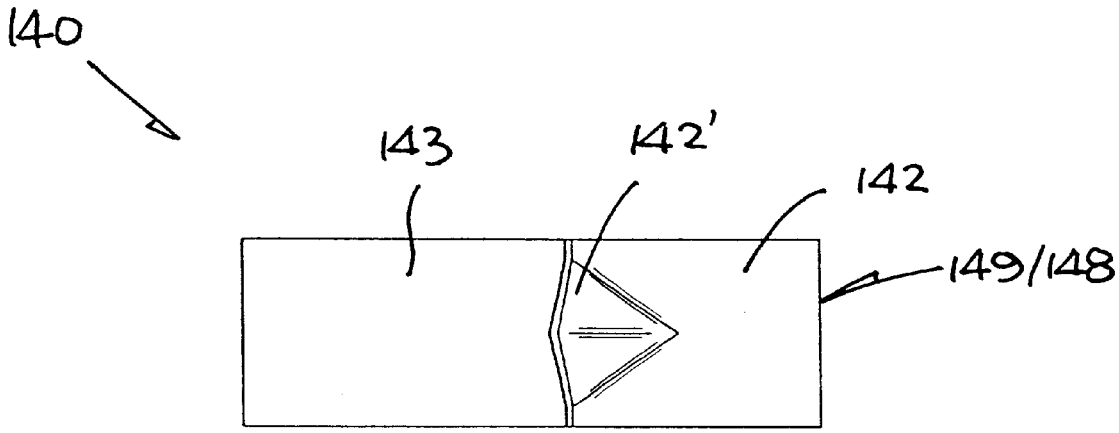
Figure 9:
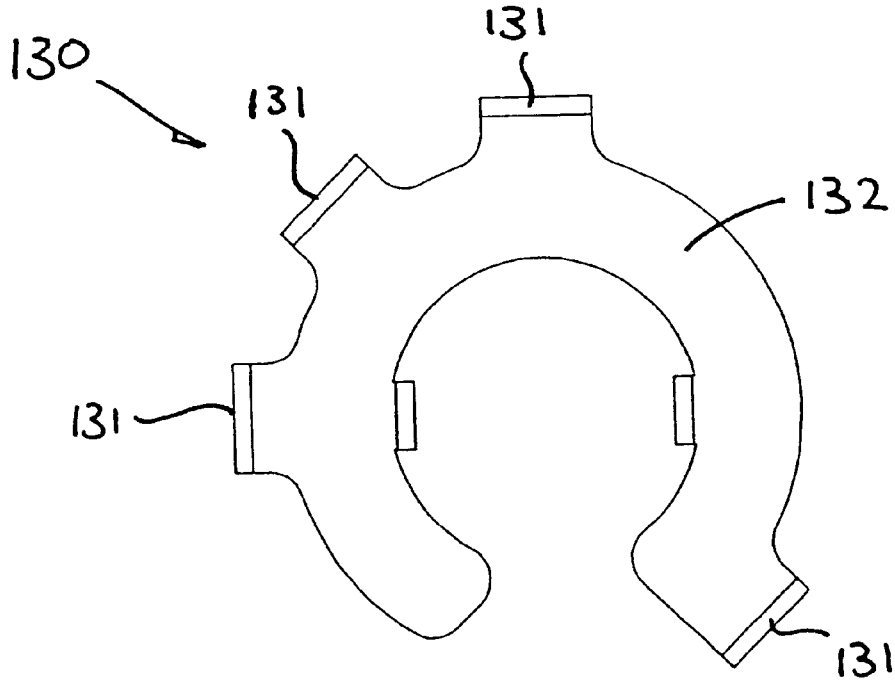
FIGS. 9 and 10 are top and side views of a moving contact of the switch of FIGS. 1 and 2.
Figure 10:
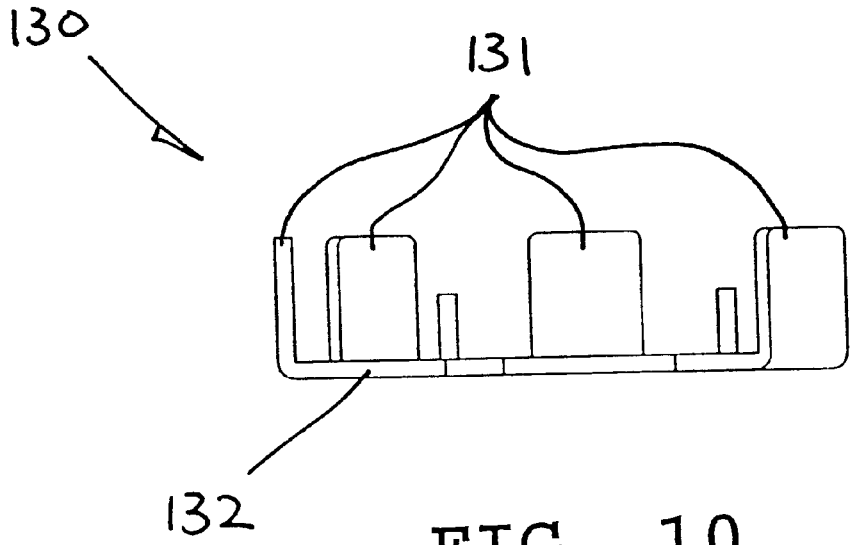

FIGS. 5 and 6 show a second ON condition (L-1-2) of the switch 100, in which the moving contact 130 has been turned through another 45° from the previous position, while remaining in contact with both fixed contacts 140-L and 140-2. Unlike the fixed contact 140-2, the live fixed contact 140-L is contacting the moving contact 130 only by means of its contact leg 144 (the second contact action alone). In addition, another fixed contact 140-1 is also in contact with the moving contact 130, by means of its front section 141. Thus, the heating elements at terminals 1 and 2 are switched to terminal L and in turn connected to the power source.

Various other switching combinations amongst the fixed contacts 140 can readily be understood, through rotation of the moving contact 130 into the other positions.

By reason of the ability to perform either one or both of the two aforesaid contact actions as a result of the presence of their additional contact legs 144, the fixed contacts 140-L and 140-2, in conjunction with the moving contact 130, can be arranged to provide a relatively larger number of different switching combinations.

The invention has been given by way of example only, and various modifications of and/or alterations to the described embodiment may be made by persons skilled in the art without departing from the scope of the invention as specified in the appended claims.

What is claimed is:

1. An electrical switch comprising a casing, a rotor supported within the casing for rotation about an axis and having a first surface extending around the axis and a second surface extending transversely of the axis, a moving contact mounted on the rotor for rotation therewith and having first and second inter-connected parts adjacent the first and second rotor surfaces respectively, and a plurality of fixed contacts located laterally of the rotor for short-circuiting by the moving contact wherein the switch is closed, at least one of the fixed contacts having first and second inter-connected parts bearing resiliently against the first and second rotor surfaces respectively for contact with the corresponding first and second moving contact parts, the first part of the at least one fixed contact for contacting the corresponding first moving contact part providing a first contact action and the second part of the at least one fixed contact for contacting the corresponding second moving contact part providing a second contact action, according to the angular position of the rotor.

2. The electrical switch as claimed in claim 1, wherein the first and second rotor surfaces include recesses locating the first and second parts of the moving contact respectively, therein accommodating their thickness.

3. The electrical switch as claimed in claim 1, wherein the rotor has a generally flat cylindrical body including a peripheral surface as its first rotor surface and one of its end surfaces as the second rotor surface.

4. The electrical switch as claimed in claim 1, wherein the second moving contact part extends partially round the axis, and the first moving contact part extends substantially at right angles relative to the second part.

5. The electrical switch as claimed in claim 4, wherein the moving contact has a generally flat body that is folded to form its first and second parts.

6. The electrical switch as claimed in claim 1, wherein the second part of said one fixed contact extends substantially at right angles relative to the first part.

7. The electrical switch as claimed in claim 6, wherein said one fixed contact has a body that comprises a base bent to form the first part and a side portion folded about the base to form the second part.

8. The electrical switch as claimed in claim 7, wherein the base of the fixed contact body is generally Z-shaped, having one end acting as the first part, the opposite end acting as a terminal for connection with an electric cable, and a middle section from which the side portion extends.

9. The electrical switch as claimed in claim 8, wherein the fixed contact body is generally T-shaped prior to the formation of its parts through bending and folding.

10. The electrical switch as claimed in claim 1, wherein the casing has a substantially square shape, including a pair of diametrically opposite corners, within each of which a respective said one fixed contact is located.

11. The electrical switch as claimed in claim 10, wherein the second moving contact part extends over 180° round the axis.

12. The electrical switch as claimed in claim 1, being a rotary switch with the rotor being rotatable over 360° in opposite directions.

* * * * *